United States Patent [19]

Kumazawa

[11] 4,045,950

[45] Sept. 6, 1977

[54] CONTROL APPARATUS FOR AN INTERMITTENTLY ROTATED WHEEL

[75] Inventor: Shoichiro Kumazawa, Kamagaya, Japan

[73] Assignee: Kabushiki Kaisha Seikosha, Japan

[21] Appl. No.: 623,016

[22] Filed: Oct. 16, 1975

[51] Int. Cl.[2] ..... G04C 3/00

[52] U.S. Cl. ..... 58/23 D; 58/28 D

[58] Field of Search ..... 58/23 R, 23 D, 28 D, 58/59, 116 R; 310/37, 49; 235/117 R, 135

[56] References Cited

U.S. PATENT DOCUMENTS 3,887,825 6/1975 Kumazawa ..... 58/23 D X

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A control device for controlling the rotation of an intermittently driven wheel comprises a lock wheel affixed to the driven wheel for rotation therewith and having a smooth, non-toothed peripheral surface. A lock lever is turnably mounted adjacent the lock wheel and has a lever arm in continuous frictional contact with the lock wheel peripheral surface. A lever spring biases the lock lever so that the lever arm applies a predetermined frictional bias force to the lock wheel peripheral surface to prevent reverse rotation of the driven wheel. The lever arm is configured so as to increase the magnitude of the bias force applied to the lock wheel whenever the driven and lock wheels tend to rotate in the reverse direction.

4 Claims, 4 Drawing Figures

CONTROL APPARATUS FOR AN INTERMITTENTLY ROTATED WHEEL

BACKGROUND OF THE INVENTION

The present invention relates to a control device for preventing reverse rotation of an intermittently rotated wheel.

In a known mechanism for preventing reverse rotation of an intermittently rotated wheel, a lock gear wheel is secured to an intermittently rotated wheel and a lock lever or a lever spring engages with said lock wheel to prevent reverse rotation.

However this conventional mechanism is disadvantageous in that it produces a ticking sound. Further it has a defect in that it is difficult to control the pressure of the lock lever or the lever spring against the lock gear wheel, since it gives delicate influence to the stop position of the intermittently rotated wheel.

SUMMARY OF THE INVENTION

The present invention intends to eliminate the disadvantages described above, and to provide a new control device for preventing reverse rotation of an intermittently rotated wheel.

According to the present invention, there is provided a control device for an intermittently rotated wheel comprising a lock wheel connected to rotate with an intermittently rotated wheel, and a rockable lock lever elastically and frictionally contacting a peripheral surface of said lock wheel to apply a continuous braking force thereto.

One object of the present invention is to prevent reverse rotation of an intermittently rotated wheel.

Another object is to prevent reverse rotation of an intermittently rotated wheel without producing a ticking sound.

Still another object of the present invention is to provide a control device for an intermittently rotated wheel which is easy to control the pressure applied for preventing reverse rotation.

BRIEF DESCRIPTION OF THE DRAWINGS

The above objects, other objects and characteristic features of the present invention will become evident and will be more readily understood from the following description and claims taken in conjunction with the accompanying drawings, in which

DESCRIPTION OF A PREFERRED EMBODIMENT

Figure 1:
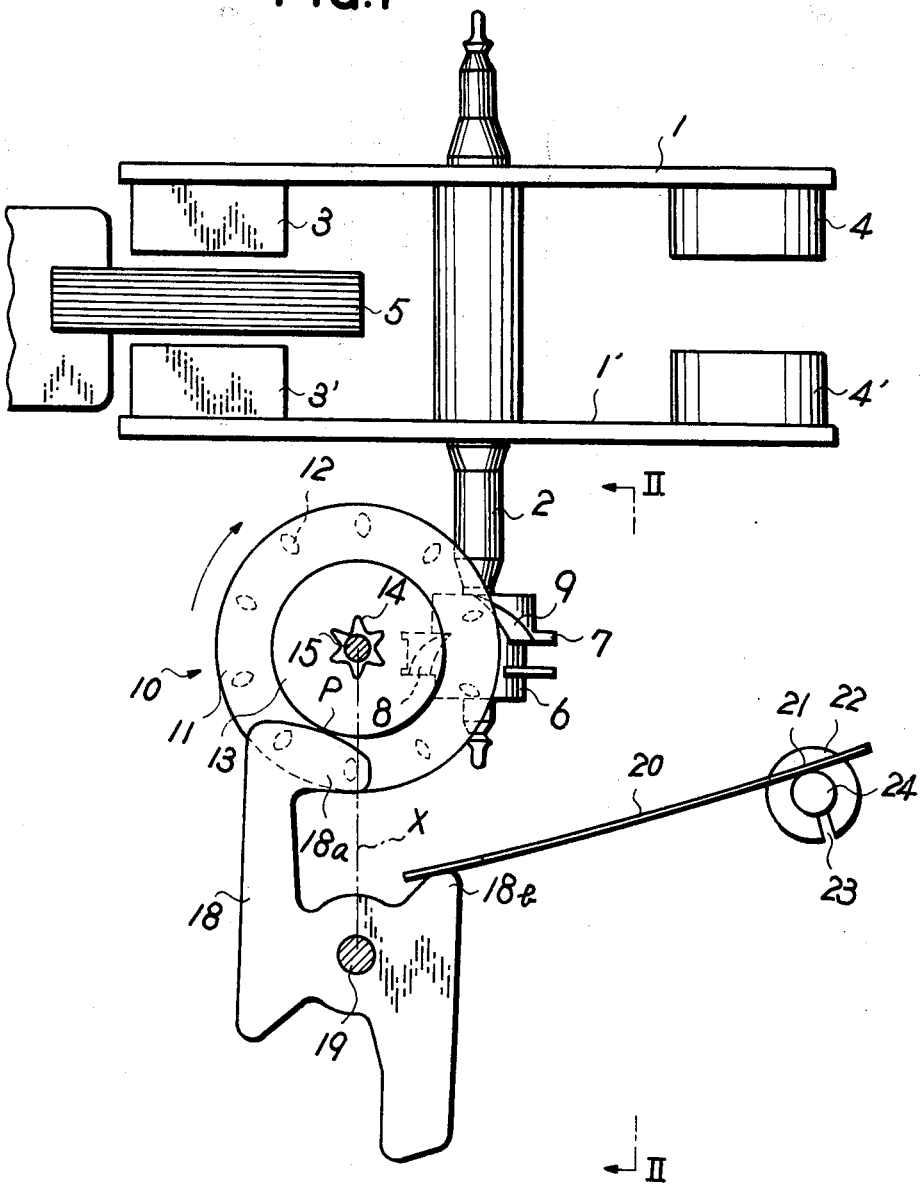
FIG. 1 is a sectional view of an embodiment according to the present invention.
Figure 2:
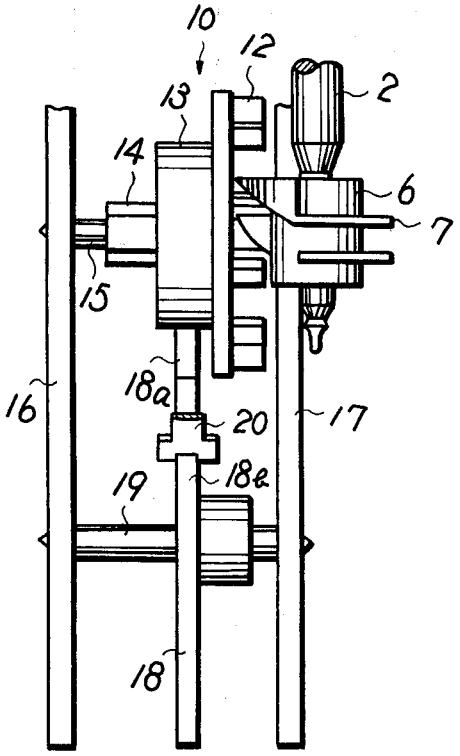
FIG. 2 is a sectional view along lines II—II in FIG. 1, and FIGS. 3 and 4 are explanatory views for explaining the coacting relation between indexing pins and a drive piece.

Referring now to the drawings, balance wheels 1, 1' are mounted spaced axially on a balance staff 2. Each balance wheel carries a drive magnet 3, 3' and a balance mass 4, 4'. The drive magnets 3, 3' face each other and a pick-up and drive coil 5 of an electromagnetic drive mechanism (not shown in full) is provided in the space between the drive magnets 3, 3'. A drive piece 6 is mounted on the balance staff 2 and rotates therewith. The drive piece 6 is provided with a rib 7, which has two tapered impulse surfaces 8, 9.

An indexing wheel structure 10 coacts with and is driven by the drive piece 6. The indexing wheel structure wheel 11 provided with outwardly extending indexing pins 12 on one face thereof, the pins being spaced from one another circumferentially at equal distances in a circle. A lock wheel 13 is fixedly connected to the indexing wheel 11, an indexing wheel pinion 14 extends coaxial with the wheels 11 and 13, and an indexing wheel arbor 15 is rotatably supported between an upper plate 16 and a middle plate 17. The pins 12 are so positioned that they may be rotated by the drive piece 6 by striking the impulse surfaces 8, 9.

A lock lever 18 is mounted on a lock lever arbor 19. This lock lever arbor 19 is rotatably supported between the upper plate 16 and the middle plate 17. One arm of the lock lever terminates in an arm end portion **18*a* of the lock lever 18 frictionally contacts the peripheral surface of the lock wheel 13 at a point P. The contact point P is positioned a little apart from a line X connecting the axis of the indexing wheel arbor 15 and the axis of the lock lever arbor 19 and is positioned forward of the line X with respect to the rotational direction of the lock wheel 13. A lever spring 20 presses another end portion 18*b* of the lock lever 18 to apply a rotary bias to the lock lever 18 in a clockwise direction in FIG. 1. Thus the end portion 18*a* of the lock lever 18 elastically contacts the peripheral surface of the lock wheel 13 the peripheral surface being smooth and non-boothed. The other end portion of the lever spring 20 is force fitted into a slit 21 provided in a collet 22. The collet 22 is provided with a cutout 23 extending from the periphery to the center hollow of the collet. The collet 22 is secured to a pin 24** which is fixed on a base plate.

In operation the balance wheels 1, 1' are rotated with an ascillatory or rocking motion by the electromagnetic mechanism and the drive piece 6 intermittently rotates the indexing wheel 11 in the forward direction impulsing the pins 12 with the impulse surfaces 8 and 9. The lock lever 18 is applied with a rotary bias by the lever spring 20 and the end portion **18*a* continuously elastically contacts the lock wheel 13 at the position P thereby applying a continuous though small frictional braking force to the lock wheel. Thus the indexing wheel 11 is steadily stopped after each intermittent rotation. During forward rotation of the wheel 11, the end portion 18*a* of the lock lever 18** slides over the lock wheel peripheral surface.

If and when the indexing wheel 11 is applied with an external force or the like tending to rotate it in the reverse direction, the end portion **18*a* of the lock lever 18 turns with the arbor 19 against the spring bias and due to its contour, frictionally pushes more forcefully against the peripheral surface of the lock wheel 13 at the point P to increases the degree of frictional contact to thereby prevent the reverse rotation. Thus the reverse rotation of the indexing wheel 11** is prevented.

In order to control the pressure applied to the lock wheel 13 by the lock lever 18, the cutout 23 in the collet 22 is spread, turned angularly about the pin 24, and the collet cutout is returned to the original state to secure to the pin.

The relation between the drive piece 6 and the indexing pins 12 is so designed that the pins may not prevent starting of the rocking motion of the drive piece.

Figure 3:
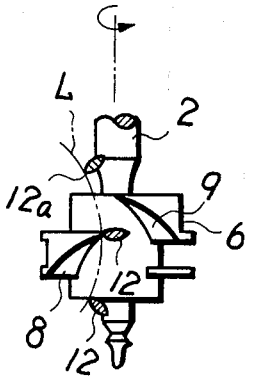
Figure 4:
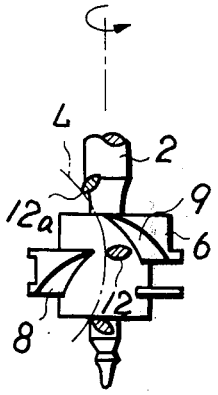

The balance wheels 1, 1' and therefore the drive piece 6 are designed to stop in the state shown in drawings, when the electromagnetic driving mechanism ceases to operate. Upon resumed operation of the electromagnetic driving mechanism, the balance staff 2 is designed to begin the first rocking motion in the direction shown by an arrow in FIGS. 3 and 4. Each indexing pin 12 may stop at any angular position on a circular locus. In case of the locus L of inside points 12*a* of the pins 12 is described as shown in FIG. 3, one pin 12 may stop at a position contacting the end portion of the impulse surface 8 of the rib 7 as shown in FIG. 3. Under this state, the drive piece 6 can not start the first rocking motion in the direction shown by the arrow because the first rocking motion is very weak. Therefore the drive piece 6 can not oscillate. In order to overcome this disadvantage, in the present embodiment, the locus L of the inside points 12*a* of the indexing pins 12 is spaced slightly from the end portion of the impulse surface 8 as shown in FIG. 4. Thus the drive piece 6 can start the first rocking motion, wherever the indexing pins 12 may be initially positioned.

What is claimed is:

1. A control device for controlling the rotation of an intermittently driven wheel comprising: a driven wheel mounted to be rotationally driven in a forward direction in a stepwise intermittent manner; a lock wheel connected to said driven wheel to be driven thereby and having a smooth non-toothed peripheral surface; a turnably mounted lock lever having a lever arm extending toward said lock wheel and terminating in an arm end portion in frictional contact with said lock wheel peripheral surface; and means including a lever spring for applying an adjustable biasing force to said lock lever tending to turn it so as to urge said arm end portion into frictional contact with said lock wheel peripheral surface with an adjustably settable frictional bias force to thereby prevent said lock wheel and driven wheel from undergoing rotation in the reverse direction.

2. A control device according to claim 1; wherein said lock lever and lock wheel are mounted to turn about axes which lie along a given line, and wherein said lock lever arm end portion contacts said lock wheel peripheral surface at a location forward of said given line with respect to the forward direction of rotation of said driven and lock wheels.

3. A control device according to claim 2; wherein said lock lever arm portion is configured so as to effect an increase in the magnitude of said bias force whenever said driven and lock wheels tend to rotate in the reverse direction against the biasing force applied by said spring lever thereby preventing such reverse rotation.

4. A control device according to claim 1; wherein said lock lever arm portion is configured so as to effect an increase in the magnitude of said bias force whenever said driven and lock wheels tend to rotate in the reverse direction against the biasing force applied by said spring lever thereby preventing such reverse rotation.

* * * * *